US006779746B2

(12) United States Patent
Gromes, Sr.

(10) Patent No.: US 6,779,746 B2
(45) Date of Patent: Aug. 24, 2004

(54) NOZZLE FOR USE WITH HIGH PRESSURE FLUID CUTTING SYSTEMS HAVING ARCUATE SIDES

(75) Inventor: Terry Dean Gromes, Sr., Navarre, OH (US)

(73) Assignee: Terydon, Inc., Navarre, OH (US)

( * ) Notice: Subject to any disclaimer, the term of this patent is extended or adjusted under 35 U.S.C. 154(b) by 0 days.

(21) Appl. No.: 10/224,775

(22) Filed: Aug. 20, 2002

(65) Prior Publication Data

US 2004/0046069 A1 Mar. 11, 2004

(51) Int. Cl.[7] ..... B05B 1/00
(52) U.S. Cl. ..... 239/596; 239/590; 239/601
(58) Field of Search ..... 239/589, 590, 239/596, 601

(56) References Cited

U.S. PATENT DOCUMENTS

| | | | | |
|---|---|---|---|---|
| 144,163 A | * | 10/1873 | Taylor | 285/260 |
| 1,192,901 A | * | 6/1916 | Irish | 239/589 |
| 1,549,458 A | * | 8/1925 | Daniels | 239/589 |
| 3,045,932 A | | 7/1962 | Steinen | |
| 3,750,961 A | | 8/1973 | Franz | |
| 4,244,521 A | | 1/1981 | Guse | |
| 4,557,217 A | | 12/1985 | Zingg | |
| 4,813,611 A | | 3/1989 | Fontana | |
| 4,852,800 A | | 8/1989 | Murdock | |
| 5,730,358 A | | 3/1998 | Raghavan et al. | |
| 5,848,753 A | | 12/1998 | Wands et al. | |
| 6,168,503 B1 | | 1/2001 | Pao et al. | |

* cited by examiner

*Primary Examiner*—Christopher Kim
(74) *Attorney, Agent, or Firm*—Sand & Sebolt

(57) ABSTRACT

A high velocity cutting nozzle for connection to the fluid supply tube of a high pressure fluid cutting system. The nozzle includes a housing which threadably connects to the fluid supply tube for receiving pressurized liquid therefrom spraying outwardly through a spray outlet bore of the housing. The housing includes a flow directing bore with a convergent inlet portion for reducing turbulence, and a bulbous outlet portion having an annular curved divergent surface and an annular curved divergent surface. An orifice disk is disposed within the housing in co-axial fluid communication with the flow-directing bore and the spray outlet bore of the housing immediately downstream of the flow-directing bore.

18 Claims, 3 Drawing Sheets

NOZZLE FOR USE WITH HIGH PRESSURE FLUID CUTTING SYSTEMS HAVING ARCUATE SIDES

BACKGROUND OF THE INVENTION

1. Technical Field

Generally, the invention relates to high pressure fluid cutting systems. Particularly, the invention relates to high velocity cutting nozzles for connection to the fluid supply tube of high pressure fluid cutting systems. Specifically, the invention relates to cutting nozzles comprising a housing which threadably connects to the fluid supply tube for receiving pressurized liquid therefrom spraying outwardly through a spray outlet bore of the housing.

2. Background Information

High pressure liquid cutting devices are commonly used for cutting various sheet materials such as plastics, and masonry materials such as brick and concrete slabs. Such cutting devices are also used for drilling and abrading materials. High pressure liquid is also often used to clean materials such as brick and masonary. Such cutting devices usually include an electric motor which drives a hydraulic pump supplying a working fluid to a high pressure intensifier unit. The intensifier draws a cutting liquid in the form of water from a reservoir, and discharges the water at a very high pressure (e.g. 20,000 to 70,000 psi or more) through the fluid supply tube to the cutting nozzle to produce a fluid jet to cut through the desired material. The fluid jet may range in diameter from about a thousandth of an inch up to about fifteen thousandths of an inch or more, at a velocity of about 1,000 to 3,000 feet per second.

Many prior art cutting nozzles are prone to prematurely wearing out due to abrasion caused by the high pressure and velocity of the water traveling through the nozzles upstream of the orifice. Turbulence upstream of the orifice also causes lack of cohesiveness of the fluid jet. That is, convergence of the various velocity vectors of the fluid within the fluid jet at the orifice only extends for a short distance upon exiting the orifice. This results in a more dispersed fluid jet having less cutting force so only shallower cuts may be made, a wider width of cut or kerf, and more overspraying or wetting of the material adjacent the cut. Conversely, a more cohesive fluid jet provides a finer fluid jet, more precise cutting, and deeper cuts.

One attempt to reduce such turbulence is the a liquid jet cutting device and method disclosed in U.S. Pat. No. 3,997,111 issued to Thomas et al. on Dec. 14, 1976. The disclosed device includes a source of high pressure fluid, a jet nozzle, and a high pressure conduit connecting the fluid source to the nozzle. A liquid collimating device is disposed directly upstream of the nozzle comprising a housing interconnected between the conduit and the nozzle. The housing defines a flow collimating chamber directly upstream of the nozzle through which the high pressure liquid is delivered to the nozzle. The cross-sectional area of the flow collimating chamber must be at least greater than one hundred times the cross-sectional area of the nozzle opening. The liquid jet produced is claimed to have relatively little dispersion and a relatively narrow kerf.

An orifice assembly and method providing highly cohesive fluid jet is disclosed in U.S. Pat. No. 5,226,597 issued to Ursic on Jul. 13, 1993. The orifice assembly includes a housing that receives pressurized fluid from a supply tube. The housing has a passageway therein through which the fluid flows. The passageway has an orifice element therein having an orifice for producing the fluid jet, and a converging section disposed upstream of the orifice that extends toward the orifice element. The converging section is designed to reduce turbulence upstream of the orifice and thus produce a more cohesive fluid jet emitted from the orifice. A section having a rounded surface is disposed between the converging section and the orifice element which joins the converging section and an upstream portion of the orifice element. The section is designed to further improve the cohesiveness of the fluid jet by further reducing turbulence upstream of the orifice.

Although these devices are adequate for the purpose for which they were intended, the first device has additional length and adds weight to the cutting assembly. Additionally, neither device directly addresses the problem of nozzle wear.

Therefore, the need exists for an improved high velocity cutting nozzle that reduces turbulence upstream of the orifice to produce a narrow kerf, and that has a significantly longer service life prior to wearing out.

SUMMARY OF THE INVENTION

Objectives of the invention include providing a high pressure nozzle which has reduced turbulence to produce a finer kerf.

Another objective of the invention is to provide such a cutting nozzle with significantly reduced internal wear due to abrasion of the water flow providing a longer service life, and which solves problems and satisfies needs existing in the art.

These objectives and advantages are obtained by the improved high velocity cutting nozzle for connection to a fluid supply tube of a high pressure fluid cutting system of the present invention, the general nature of which may be stated as including: a housing adapted for connection to the fluid supply tube having a flow-directing bore for receiving a liquid from the fluid supply tube and extending partially through the housing, the flow directing bore including a convergent inlet portion having an annular inner surface for reducing turbulence in the flow-directing bore, and a bulbous outlet portion having an annular curved divergent surface and an annular curved convergent surface, and a spray outlet bore extending inwardly from a front surface of the housing in fluid communication with the bulbous outlet portion of the flow-directing bore through which the liquid is directed as a high velocity liquid cutting jet; and an orifice plate disposed within the housing in co-axial fluid communication with the flow-directing bore and the spray outlet bore immediately downstream of the flow-directing bore, the orifice plate having an orifice of a diameter that is smaller than a minimum diameter of the flow-directing bore for producing a high velocity fluid jet.

According to another aspect, the objectives and advantages are obtained by the improved method for extending the service life of a high velocity cutting nozzle, the general nature of which may be stated as including the steps of: producing a flow of high pressure fluid; passing the flow through a flow-directing bore including a convergent inlet portion having an annular inner surface, and through a bulbous outlet portion having an annular curved divergent surface and an annular curved convergent surface; and passing the flow through an orifice closely adjacent the flow-directing bore having an orifice of a diameter that is smaller than a minimum diameter of the flow-directing bore for producing a high velocity fluid jet.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 1:
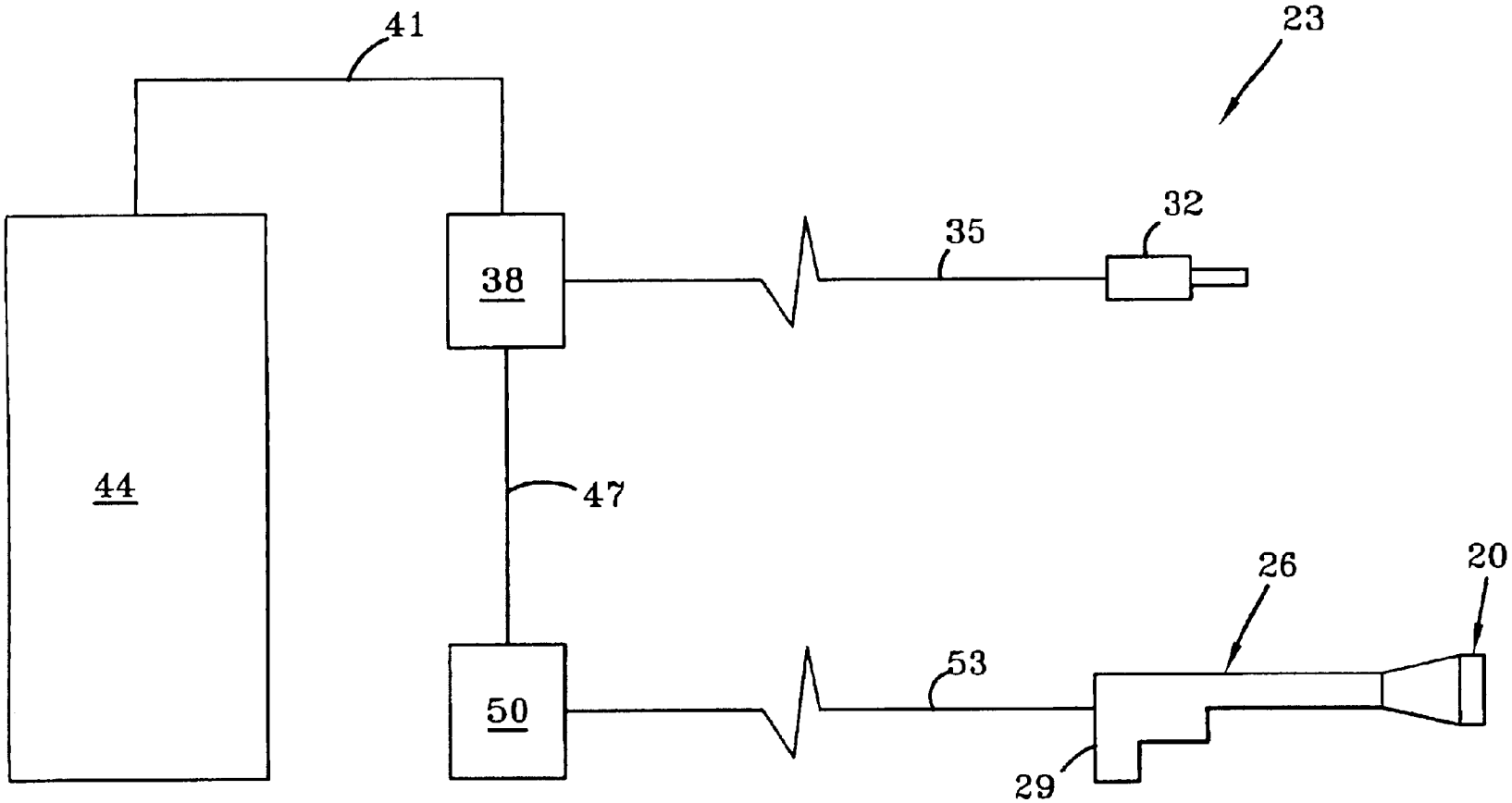
FIG. 1 is a schematic view of a high pressure water cutting system of the type that may utilize the cutting nozzle of the present invention.
Figure 2:
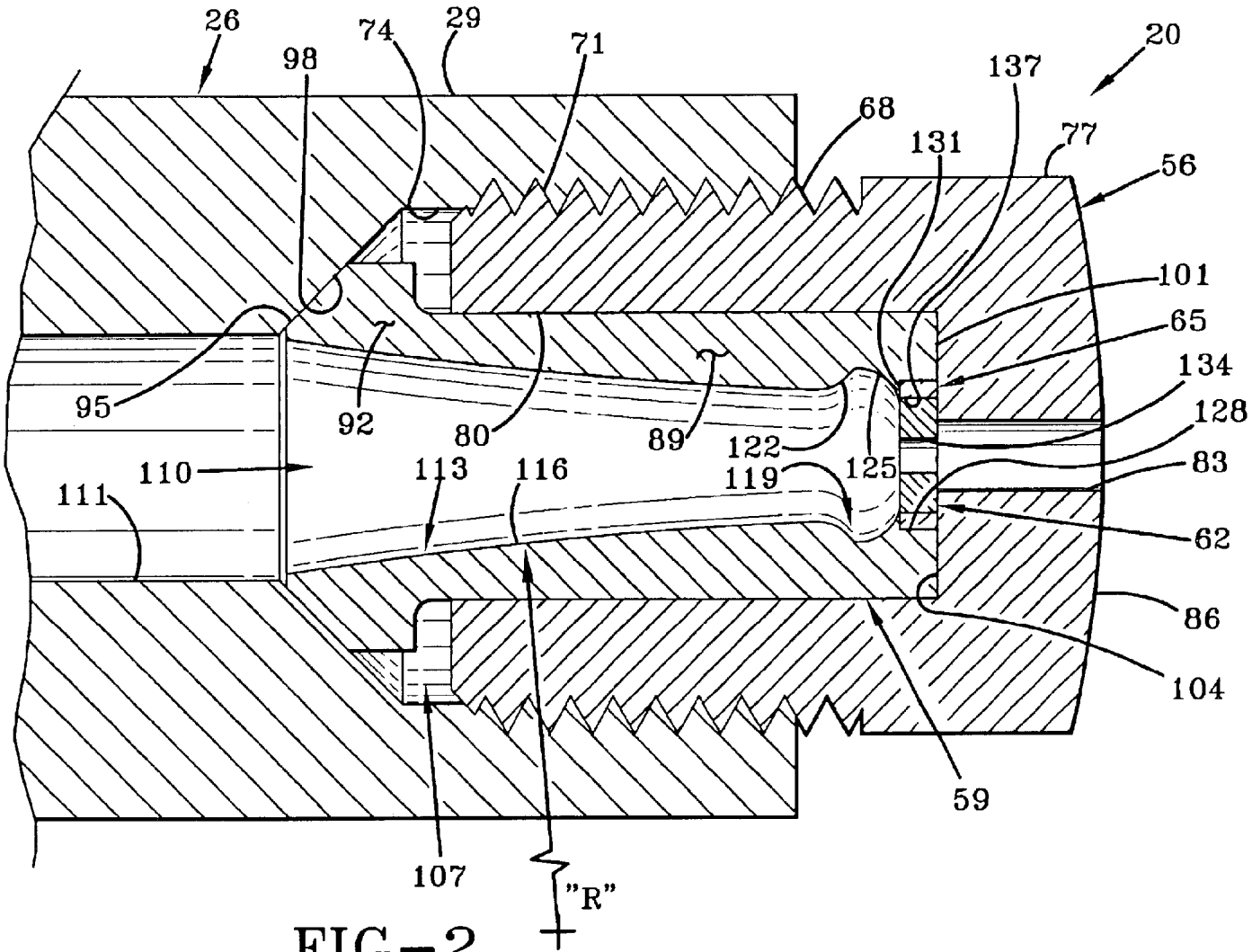
FIG. 2 is a fragmentary longitudinal sectional view of the cutting nozzle of the present invention.
Figure 3:
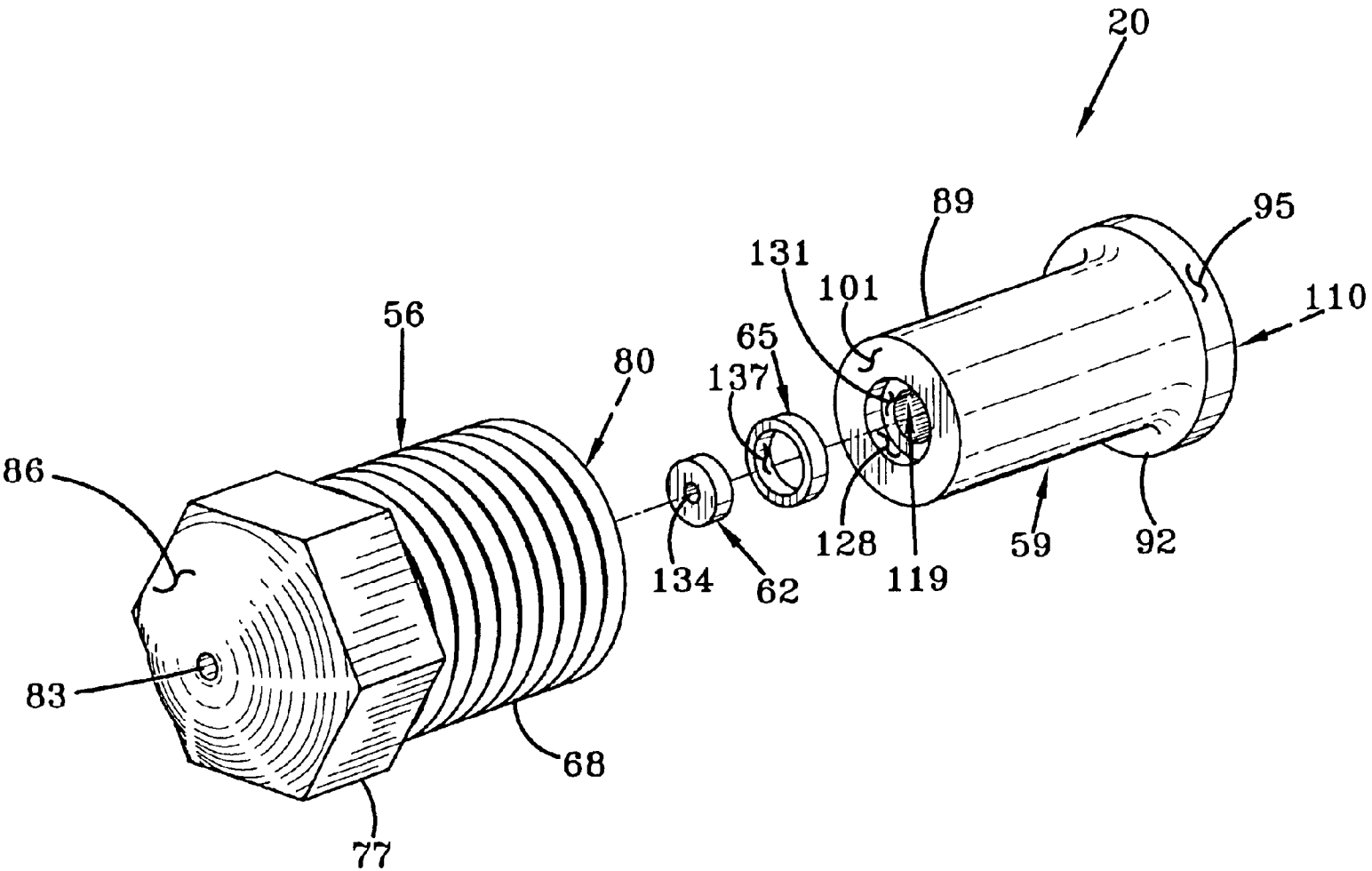
FIG. 3 is an exploded perspective view of the cutting nozzle.

The high velocity cutting nozzle of the present invention is shown in FIGS. 1 and 2, and is indicated generally at 20. Cutting nozzle 20 is shown in FIG. 1 positioned as part of a high pressure water cutting system 23. Cutting system 23 includes a cutting gun 26 having a fluid supply tube 29 to which the cutting nozzle 20 is engaged as explained subsequently. Gun 26 receives high pressure water produced by an electric powered hydraulic pump 32 that supplies a working fluid such as hydraulic fluid through a pipe 35 to a high pressure intensifier unit 38. The intensifier unit 38 draws a suitable cutting fluid (i.e. water) through a pipe 41 from a reservoir 44, and discharges the water at a very high pressure through a pipe 47 to an ultra-fine filter 50 to remove any small particulates that might plug up the cutting nozzle 20. The water passes from filter 50 through a pipe 53 to the fluid supply tube 29 of gun 26.

Cutting nozzle 20 includes a housing 56 preferably made of high strength steel, a bushing 59 preferably made of steel, an orifice disk 62 preferably made of sapphire, and a sleeve 65 preferably made of plastic or rubber or other such material. The housing 56 is generally cylindrical in shape, having an externally threaded portion 68 configured to engage an internally threaded portion 71 of a bore 74 of fluid supply tube 26 of standard guns 26, and a wrench engaging external hexagonal portion 77 adapted to be engaged by standard hex wrenches (not shown). A bushing receiving bore 80 extends through the threaded portion 68 and partially into the hexagonal portion 77. A spray outlet bore 83 extends from a convex front surface 86 of housing 56 into the hexagonal portion 77 and joins with the bushing receiving bore 80. The bushing 59 includes a cylindrical body 89 terminating at a head 92, the body 89 being of a diameter to closely fit within the bushing receiving bore 80, with head 92 being of a larger diameter. Head 92 includes a frustoconical or annular tapered surface 95 adapted to engage a mating frustoconical or annular tapered surface 98 of fluid supply tube 29 when cutting nozzle 20 is assembled to gun 26. A flat end surface 101 of bushing 59 closely engages a mating circular surface 104 of housing 56 within bushing receiving bore 80 when bushing 59 is assembled within housing 56, with an annular space 107 remaining between head 92 and threaded portion 68. The bushing 59 further includes a flow directing bore 110 coaxially disposed with a water outlet bore 111 of fluid supply tube 29 of gun 26, the flow directing bore 110 having a longitudinally tapered inlet portion 113 having a funnel-shaped surface 116 and a bulbous outlet portion 119 having an annular curved divergent surface 122 and an annular curved convergent surface 125. Surfaces 116, 122 and 125 are smoothly connected to one another. A sleeve receiving bore 128 extends inwardly from flat surface 101 of bushing 59 joining with the bulbous outlet portion of flow directing bore 110 at a shoulder 131. The orifice disk 62 includes an orifice 134 of a desired cutting diameter, and pressfits into an inner bore 137 of sleeve 65. Sleeve 65 closely, but removably fits into the sleeve receiving bore 128 of bushing 59.

The cutting nozzle 20 threadably connects to the fluid supply tube 29 of gun 26 by engaging a wrench to the external hexagonal portion 77 of housing 56. The annular tapered surface 95 of bushing 59 engages the annular tapered surface 98 of fluid supply tube 29 as cutting nozzle 20 is tightened, forcing bushing 59 further into the bushing receiving bore 80. The flat end surface 101 of bushing 59 closely engages the mating circular surface 104 of housing 56 within bushing receiving bore 80, sealing nozzle 20 to fluid supply tube 29. The orifice disk 62 and sleeve 65 are retained within the sleeve receiving bore 128 by the shoulder 131 without being pressfit or otherwise affixed therein. Therefore, upon disassembly of cutting nozzle 20, the orifice disk 62 with sleeve 65 readily slides out of the sleeve receiving bore 128 without using tools, and may be replaced by an orifice disk 149 within another sleeve 65 having a different size orifice 152 to suite a different cutting job. Likewise, when orifice disk 62 wears out, it may readily be replaced without throwing out the entire cutting nozzle 20. The cutting nozzle 20 fastens directly to conventional fluid supply tubes 29 and requires no modification thereto. Note that the bushing 59 may be integrally incorporated into the housing 56 where it is not necessary that the orifice disk 62 and sleeve 65 be replaceable.

The method of operation includes the following steps: 1) producing a flow of high pressure fluid; passing the flow through a flow-directing bore including a convergent inlet portion having an annular inner surface, and through a bulbous outlet portion having an annular curved divergent surface and an annular curved convergent surface; and 3) passing the flow through an orifice closely adjacent the flow-directing bore having an orifice of a diameter that is smaller than a minimum diameter of the flow-directing bore for producing a high velocity fluid jet. The annular inner surface of the convergent inlet portion is preferably slightly inwardly convex. In operation, it is believed that the inwardly convex convergent inlet portion of the flow directing bore stabilizes the flow of water to reduces turbulence in the flow-directing bore, producing a more laminar and coherent flow prior to entering the orifice. The bulbous outlet portion produces a doughnut shaped flow ahead of the orifice, acting as a liquid bearing which reduces friction of the laminar main flow prior to entering the orifice. The result is less turbulence in the flow producing less wear and a tighter kerf.

It is understood that various materials other than those listed may be used in the construction of the cutting nozzles and various finishes be applied. For example, the bushing might be made of brass or a sand blast finish applied to all the water contacting surfaces rather than a smooth finish to improve cohesiveness of the flow. Also, other housing and bushing configurations may be devised. For example, the sleeve receiving bore may be disposed in the housing rather than in the bushing.

Accordingly, the cutting nozzles provide reduced turbulence to produce a finer kerf, and significantly reduced internal wear due to abrasion of the water flow providing a longer service life which achieves all the enumerated objectives, provides for eliminating difficulties encountered with prior art devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved high velocity cutting nozzle is constructed and used, the characteristics of the construction, and the advantageous, new and useful results obtained; the new and useful structures, devices, elements, arrangements, parts and combinations, are set forth in the appended claims.

What is claimed is:

1. A high velocity nozzle for connection to a fluid supply tube of a high pressure fluid cutting system, comprising:

a housing adapted for connection to the fluid supply tube having a flow-directing bore for receiving a liquid from the fluid supply tube and extending partially through said housing, said flow directing bore including a convergent inlet portion having an annular inner surface for reducing turbulence in said flow-directing bore, and a bulbous outlet portion having an annular curved divergent surface and an annular curved convergent surface, and a spray outlet bore extending inwardly from a front surface of said housing in fluid communication with said bulbous outlet portion of said flow-directing bore through which the liquid is directed; and an orifice plate disposed within said housing in co-axial fluid communication with said flow-directing bore and said spray outlet bore, said orifice plate having an orifice of a diameter that is smaller than a minimum diameter of said flow-directing bore disposed between said flow-directing bore and said spray outlet bore.

2. The nozzle defined in claim 1 in which the orifice plate comprises an orifice disk.

3. The nozzle defined in claim 1 in which the orifice plate comprises a jewel orifice.

4. The nozzle defined in claim 3 in which the jewel orifice comprises sapphire.

5. The nozzle defined in claim 1 in which the housing includes a rearwardly tapering frustoconical surface for contacting a mating frustoconical surface of the fluid supply tube so as to form a seal between said housing and the fluid supply tube.

6. The nozzle defined in claim 5 in which the housing includes an externally threaded portion configured to engage a mating internally threaded portion of the fluid supply tube, and an external wrench engaging portion for tightening said housing to the fluid supply tube.

7. The nozzle defined in claim 1 in which the annular inner surface of the convergent inlet portion is slightly inwardly convex.

8. A high velocity nozzle for connection to a fluid supply tube of a high pressure fluid cutting system, comprising:

a housing adapted for connection to the fluid supply tube having a flow-directing bore for receiving a liquid from the fluid supply tube and extending partially through said housing, said flow directing bore including a convergent inlet portion having an annular inner surface that is slightly inwardly convex for reducing turbulence in said flow-directing bore, and a bulbous outlet portion having an annular curved divergent surface and an annular curved convergent surface, and a spray outlet bore extending inwardly from a front surface of said housing in fluid communication with said bulbous outlet portion of said flow-directing bore through which the liquid is directed as a high velocity liquid cutting jet; and an orifice plate disposed within said housing in co-axial fluid communication with said flow-directing bore and said spray outlet bore, said orifice plate having an orifice of a diameter that is smaller than a minimum diameter of said flow-directing bore disposed between said flow-directing bore and said spray outlet bore for producing a high velocity fluid jet.

9. The nozzle defined in claim 8 in which the orifice plate comprises an orifice disk.

10. The nozzle defined in claim 8 in which the orifice plate comprises a jewel orifice.

11. The nozzle defined in claim 10 in which the jewel orifice comprises sapphire.

12. The nozzle defined in claim 8 in which the housing includes a rearwardly tapering frustoconical surface for contacting a mating frustoconical surface of the fluid supply tube so as to form a seal between said housing and the fluid supply tube.

13. The nozzle defined in claim 12 in which the housing includes an externally threaded portion configured to engage a mating internally threaded portion of the fluid supply tube, and an external wrench engaging portion for tightening said housing to the fluid supply tube.

14. The nozzle defined in claim 8 in which the housing includes a rearwardly tapering frustoconical surface for contacting a mating frustoconical surface of the fluid supply tube so as to form a seal between said housing and the fluid supply tube, and said housing includes an externally threaded portion configured to engage a mating internally threaded portion of the fluid supply tube, and an external wrench engaging portion for tightening said housing to the fluid supply tube.

15. The nozzle defined in claim 14 in which the orifice plate comprises an orifice disk.

16. The nozzle defined in claim 15 in which the orifice disk comprises a jewel orifice.

17. The nozzle defined in claim 16 in which the jewel orifice comprises sapphire.

18. The nozzle defined in claim 14 in which the orifice plate comprises a jewel orifice in the form of a sapphire.

* * * * *

UNITED STATES PATENT AND TRADEMARK OFFICE

CERTIFICATE OF CORRECTION

PATENT NO. : 6,779,746 B2
DATED : August 24, 2004
INVENTOR(S) : Terry Dean Gromes, Sr.

It is certified that error appears in the above-identified patent and that said Letters Patent is hereby corrected as shown below:

Title page,
Item [56], References Cited, U.S. PATENT DOCUMENTS, add:

| | | | |
|---|---|---|---|
| -- | 3,997,111 | 12/1976 | Thomas et al…….239/1 |
| | 5,226,597 | 7/1993 | Ursic…….239/11 -- |

Signed and Sealed this

Twenty-ninth Day of March, 2005

JON W. DUDAS
*Director of the United States Patent and Trademark Office*